US007832417B2

(12) United States Patent
Gunnerson et al.

(10) Patent No.: US 7,832,417 B2
(45) Date of Patent: Nov. 16, 2010

(54) DISPENSER FOR A DRAWER-TYPE DISHWASHER

(75) Inventors: Kory A. Gunnerson, West Lafayette, IN (US); Kristen K. Hedstrom, Orlando, FL (US); Mark E. Palm, Orlando, FL (US); David K. Reynolds, Jackson, TN (US); Rodney M. Welch, Beech Bluff, TN (US); Dean A. Werthman, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 960 days.

(21) Appl. No.: 11/700,005

(22) Filed: Jan. 31, 2007

(65) Prior Publication Data

US 2007/0246070 A1 Oct. 25, 2007

Related U.S. Application Data

(60) Provisional application No. 60/793,306, filed on Apr. 20, 2006.

(51) Int. Cl.
*A47L 15/44* (2006.01)
*A47L 15/42* (2006.01)

(52) U.S. Cl. ..... 134/95.1; 134/56 D; 134/93

(58) Field of Classification Search ..... 134/95.1
See application file for complete search history.

(56) References Cited

U.S. PATENT DOCUMENTS

RE24,198 E 8/1956 Sharp et al.
RE25,814 E 6/1965 Buzicky et al.
4,735,228 A * 4/1988 Boedecker et al. ..... 137/268
5,133,487 A 7/1992 Russi
5,176,297 A 1/1993 Mooney et al.
5,186,912 A * 2/1993 Steindorf et al. ..... 422/263
5,603,431 A 2/1997 Tuller
6,138,693 A 10/2000 Matz
6,189,551 B1 2/2001 Sargeant et al.
6,294,767 B1 * 9/2001 Sargeant et al. ..... 219/519
6,474,351 B1 11/2002 Cerruti et al.

(Continued)

FOREIGN PATENT DOCUMENTS

EP 0602572 A1 6/1994

(Continued)

*Primary Examiner*—Michael Barr
*Assistant Examiner*—Jason P Riggleman
(74) *Attorney, Agent, or Firm*—Robert A. Bacon; Diederiks & Whitelaw, PLC

(57) ABSTRACT

A drawer-type dishwasher includes a dispenser mounted to a basin slidably supported in an outer body of the dishwasher. The dispenser includes a main body portion, a reservoir formed in the main body portion for receiving detergent and a lid hingedly mounted for selectivity closing the reservoir. The reservoir includes front, rear, bottom and opposing side walls, with one of the front, rear and opposing side walls being provided with a drainage port which is adapted to be closed by the lid. The dispenser is provided with a manual actuator that enables a consumer to open the dispenser lid to add detergent. An automatic actuator is provided to open the dispenser lid, exposing the reservoir and the drainage port, at a predetermined point in a washing operation. In addition to detergent, the dispenser can be provided with a reservoir for retaining and releasing rinse aid.

14 Claims, 14 Drawing Sheets

U.S. PATENT DOCUMENTS

| | | | | |
|---|---|---|---|---|
| 7,063,092 | B2 | 6/2006 | Cerruti | |
| 2004/0069325 | A1 | 4/2004 | Cerruti et al. | |
| 2007/0246077 | A1 * | 10/2007 | Simmons et al. | 134/25.2 |

FOREIGN PATENT DOCUMENTS

| | | | |
|---|---|---|---|
| EP | 0719517 | A2 * | 12/1995 |
| EP | 1281346 | A1 | 2/2003 |
| WO | 01/97674 | A2 | 12/2001 |
| WO | WO01/97674 | A2 * | 12/2001 |
| WO | 02/069779 | A1 | 9/2002 |

* cited by examiner

DISPENSER FOR A DRAWER-TYPE DISHWASHER

CROSS-REFERENCE TO RELATED APPLICATION

The present application claims the benefit of U.S. Provisional Patent Application Ser. No. 60/793,306 filed Apr. 20, 2006 entitled "Dispenser For a Drawer-Type Dishwasher."

BACKGROUND OF THE INVENTION

1. Field of the Invention

The present invention pertains to the art of drawer-type dishwashers and, more particularly, to a dispenser for storing and releasing detergent and/or rinse aid into a wash chamber of a drawer-type dishwasher.

2. Discussion of the Prior Art

In general, dishwashers having a pull-out drawer are known in the art. In some models, the dishwasher will include an upper pull-out drawer forming a washing chamber for washing smaller objects such as glassware, utensils, small plates and the like, and a lower conventional-type dishwasher. In other models, the dishwasher will include upper and lower pull-out washing chambers or just simply include a single pull-out type washing chamber. In any event, the pull-out washing chamber must be provided with a dispenser that releases detergent and/or rinse aid into the washing chamber during a washing operation.

In conventional dishwashers, dispensers for detergent and rinse aid are typically located on a door assembly. At the start of a washing operation, the door assembly is opened, the dispenser loaded and, after loading dishes, the door assembly is closed. During the washing operation, a mechanism opens the dispenser allowing detergent to fall into the dishwasher. However, unlike conventional dishwashers, drawer-type dishwashers do not include a door assembly that enables a consumer to load detergent in a horizontal orientation for dispensing in a vertical orientation.

Detergent dispensers for a drawer-type dishwasher are typically mounted to or formed in a front wall of the drawer. One dispenser design includes a pull-out or pivoting chamber. With this design, the dispenser is loaded with detergent and pivoted back into a receptacle formed in the front wall of the drawer. At a prescribed time during the washing operation, a jet of water is directed from a nozzle formed in the receptacle into the dispenser. The jet of water washes the detergent through an opening formed in a bottom of the receptacle and into the drawer. While effective, this design requires tubing to be formed into the drawer during manufacturing which raises the complexity of manufacturing and the overall cost of the appliance.

Other designs utilize disposable containers that are supported on a side wall of the drawer. A single or multi-use container, coupled to an actuation mechanism, dispenses a prescribed amount of detergent at a predetermined point in the washing operation. Once the container is depleted, a new container is positioned in the drawer. While this method is also effective, consumers are faced with limited choices. That is, not all detergent manufacturers have developed or offer containers of this type.

Based on the above, there exists a need for a dispenser for a drawer-type dishwasher. More specifically, there exists a need for a dispenser for releasing detergent and/or rinse aid that can be mounted to a side wall of the dishwasher without requiring special jets to wash the detergent into the drawer or specific, single use containers to retain and release the detergent during a wash operation.

SUMMARY OF THE INVENTION

The present invention is directed to a dispenser for a drawer-type dishwasher. The dispenser is mounted to one of front and opposing side walls of a basin or wash tub slidably supported in an outer body of the dishwasher. In accordance with the invention, the dispenser includes a main body portion, a reservoir formed in the main body portion for receiving detergent, and a lid hingedly mounted to the main body portion for selectivity closing the reservoir. In further accordance with the invention, the reservoir includes front, rear, bottom and opposing side walls with one of the front, rear and opposing side walls being provided with a drainage port.

In still further accordance with the invention, the dispenser is provided with a first actuator for manually operating the lid and a second actuator for automatic operation of the lid. The first or manual actuator is constituted by a button, lever or other manually activated device that enables a consumer to open the dispenser lid to add detergent. The second or automatic actuator is provided to open the dispenser lid at a predetermined point of a washing operation. Once open, washing fluid flowing from a wash arm of the dishwasher enters the reservoir causing the detergent to wash over the walls into the basin. The drainage port provides an opening that permits any residual washing fluid in the reservoir to drain into the wash tub. In addition to detergent, the dispenser could also be provided with a reservoir for retaining and selectively releasing rinse aid.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
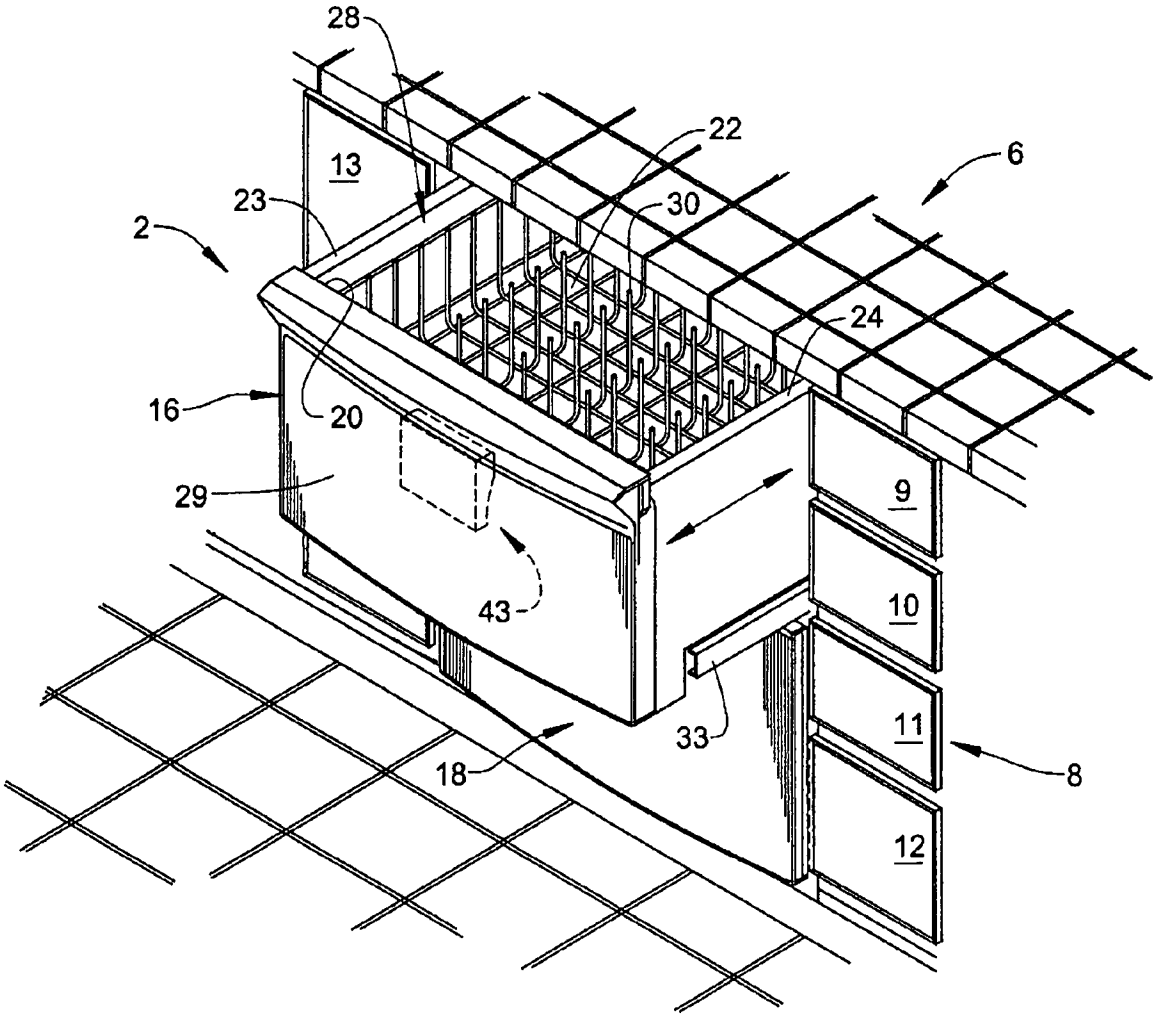
FIG. 1 is an upper right perspective view of a dishwasher incorporating a detergent dispenser constructed in accordance with the present invention.

With initial reference to FIG. 1, a dishwasher constructed in accordance with the present invention is generally indicated at 2. As shown, dishwasher 2 includes an outer body (not separately labeled) arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher having an upper washing unit 16 and a lower washing unit 18. Upper and lower washing units 16 and 18 take the form of drawers capable of operating either singly or in combination.

In the embodiment shown, upper washing unit or drawer 16 is shown to include a front wall 20, rear wall (not shown), bottom wall 22 and opposing side walls 23 and 24 that collectively define a wash tub or basin 28 having a frontal surface 29. In a manner known in the art, basin 28 is provided with a dish rack 30 for supporting various objects, such as dishware, glassware and the like, that are exposed to a washing operation. In a manner also known in the art, upper drawer 16 is slidingly supported within an outer body (not separately labeled) through a pair of extensible support guides, one of which is indicated at 33. In addition, it should be understood that, although not shown, each drawer 16, 18 is provided with a corresponding lid member (not shown) that selectively seals a respective basin 28. In any event, the above description is provided for the sake of completeness and to enable a better understanding of the drawings. The present invention is particularly directed to a dispenser, such as indicated at 43, for selectively storing and subsequently releasing detergent and/or rinse aid for a washing operation.

Figure 2:
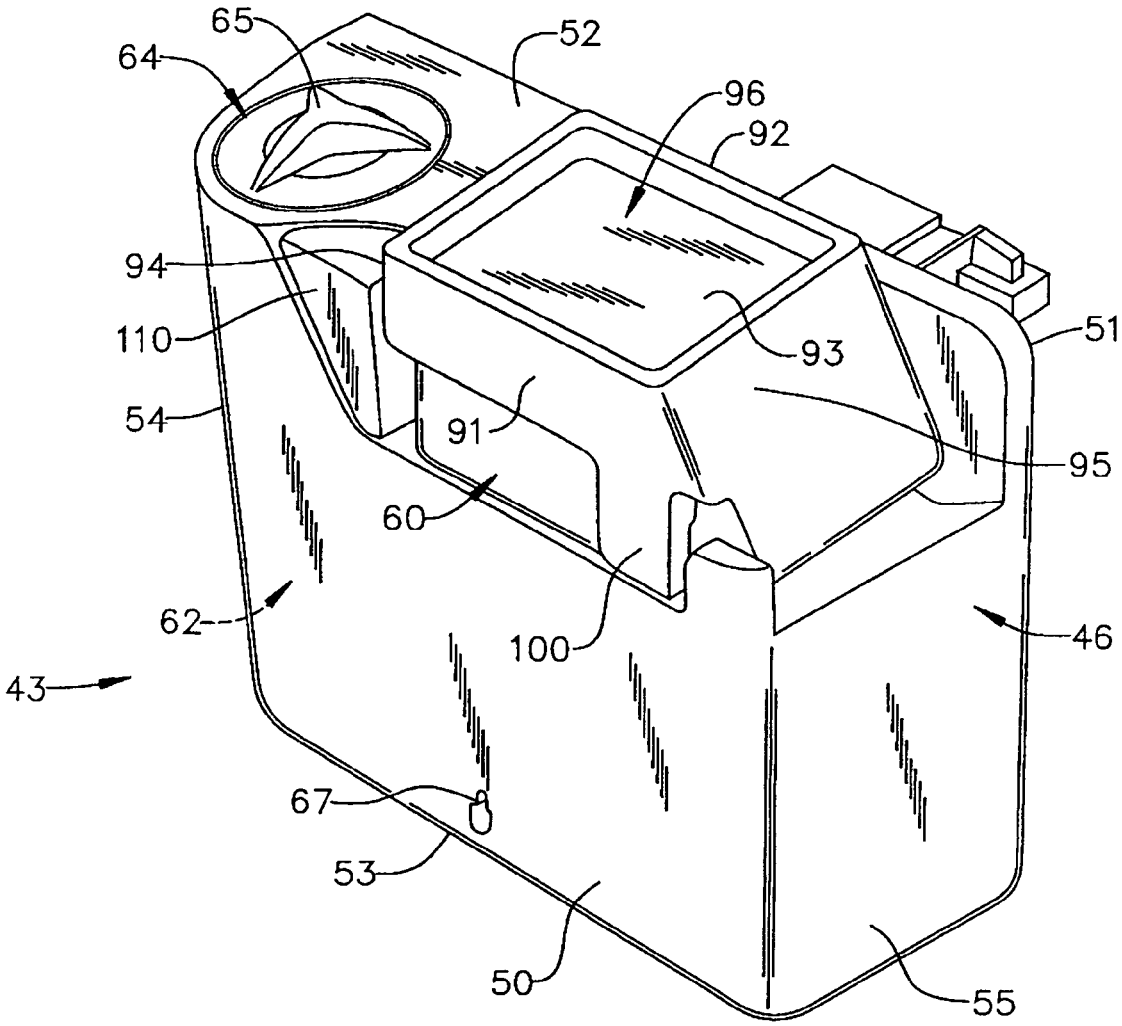
FIG. 2 is an enlarged upper right perspective view of the detergent dispenser of FIG. 1 constructed in accordance with one embodiment of the present invention.
Figure 3:
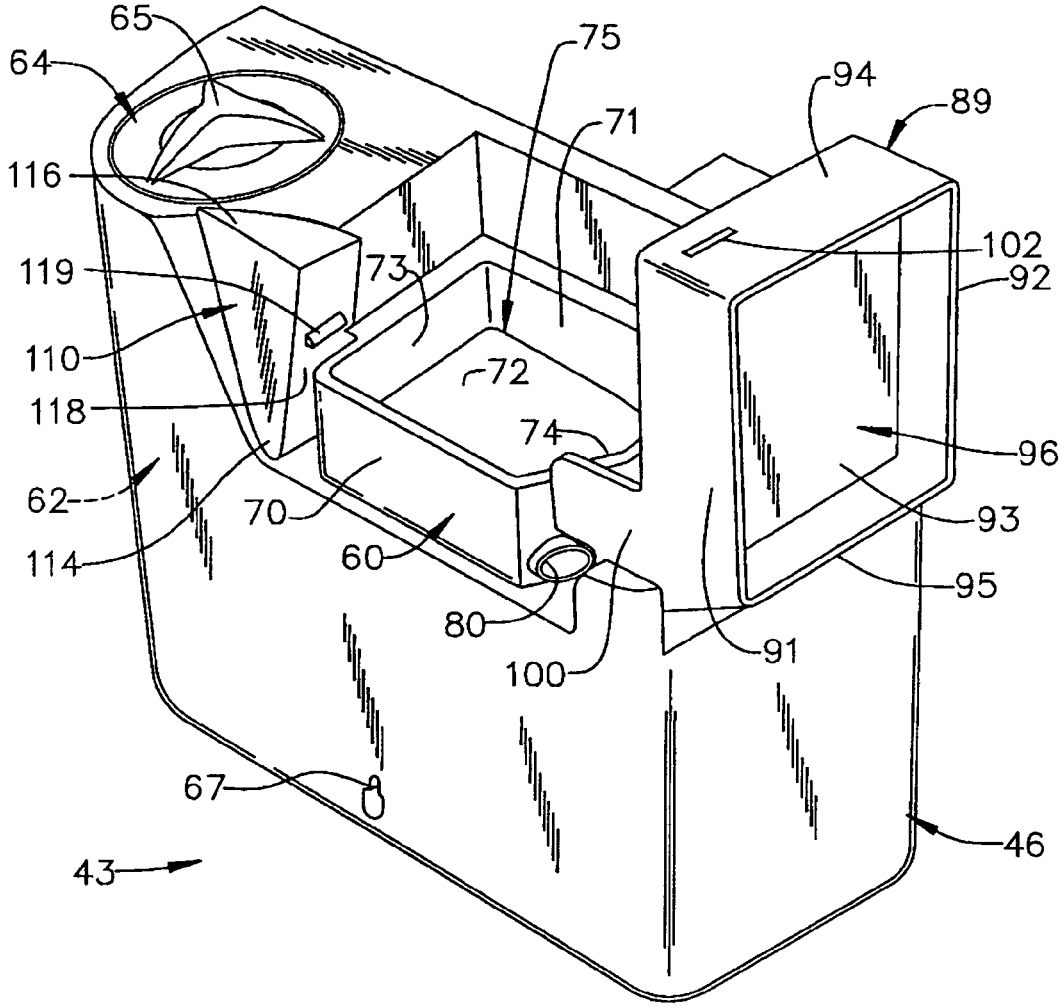
FIG. 3 is an is a perspective view of the detergent dispenser of FIG. 2 illustrated with a lid portion of the dispenser in an open configuration.

With reference to FIGS. 2 and 3, dispenser 43 includes a main body portion 46 having front, rear, top, bottom and opposing side portions 50-55. Main body portion 46 includes a first reservoir 60 for receiving and selectively releasing dishwashing detergent and a second reservoir 62 for storing and selectively releasing rinse aide. Reservoir 60 is sized and shaped so as to receive a variety of forms of dishwashing detergent, such as liquid, solid particulate and formed blocks. Second reservoir 62 is provided with a lid 64 having a raised area 65 which enables a consumer to readily grasp and remove lid 64 in order to expose second reservoir 62, thereby permitting rinse aid to be introduced therein. As will be detailed more fully below, the rinse aid is ejected or released from second reservoir 62 through an opening 67 provided in front portion 50 during select portions of the washing operation, particularly just prior to a final rinse cycle.

As best shown in FIG. 3, first reservoir 60 includes a front wall 70, rear wall 71, bottom wall 72 and opposing side walls 73 and 74 which collectively define a chamber 75. In accordance with the invention, chamber 75 is provided with a drain port 80 located adjacent bottom wall 72. Drain port 80 is provided to allow detergent to be rinsed from first reservoir 60. That is, drain port 80 is sized so as to ensure that liquid (gel) or particulate detergent can be maintained within chamber 75 until such a time as that detergent is diluted with water to form a washing solution. Once diluted, the detergent is capable of passing through drain port 80 into basin 28.

In order to prevent prematurely exposing the detergent held within first reservoir 60 to a flow of diluting water, dispenser 43 is provided with a lid 89 pivotally mounted relative to main body portion 46. As shown, lid 89 includes front, rear, top and opposing side sections 91-95 which, in one preferred arrangement, collectively define a third reservoir 96. Third reservoir 96 can be employed to store or hold detergent for providing a pre-wash to dishware located within basin 28. Lid 89 is also shown to include an extension 100 which selectively closes drain port 80 when lid 89 is in a closed position. Also, lid 89 is provided with a recess 102 which, as will be discussed more fully below, is provided to selectively retain lid 89 in a closed position.

Figure 4:
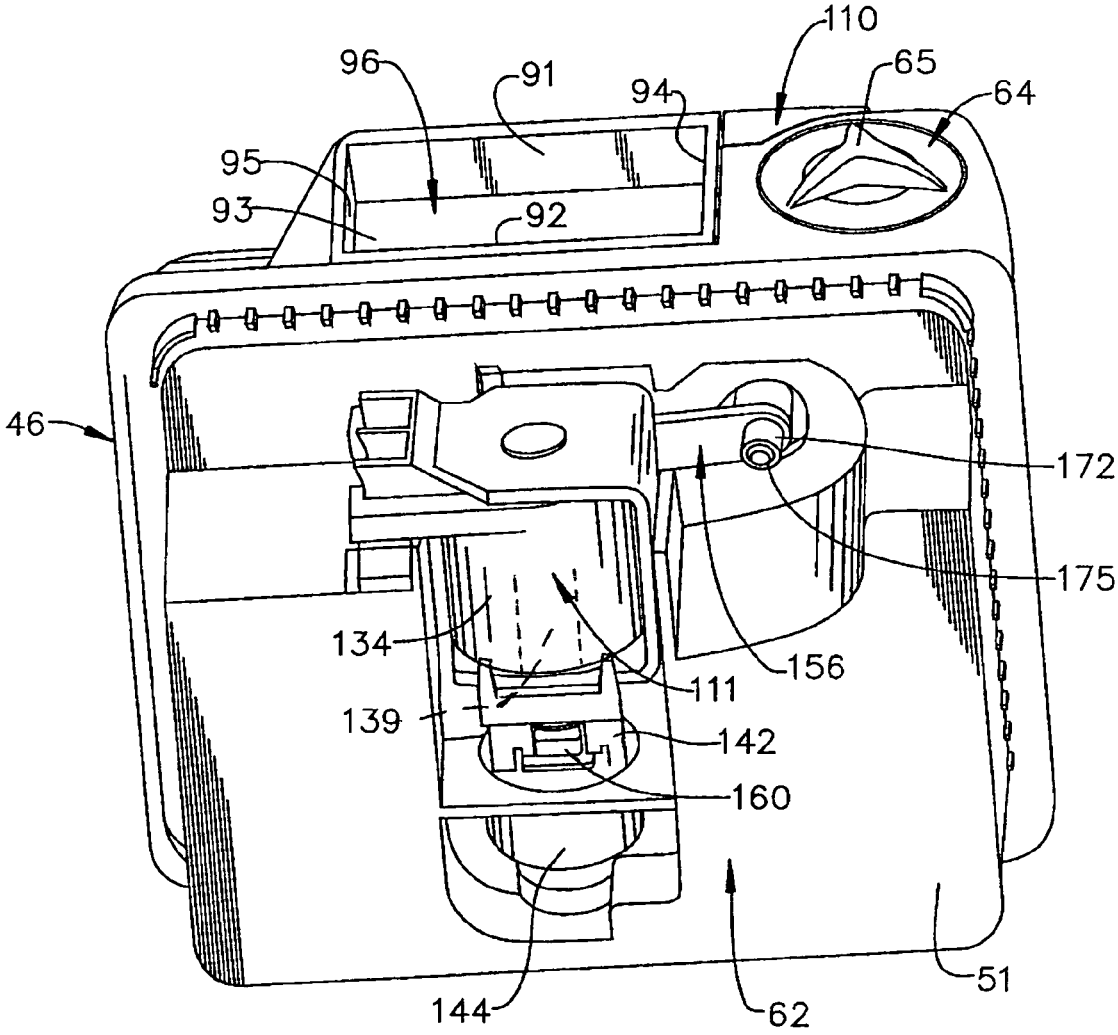
FIG. 4 is a rear perspective view of the detergent dispenser of FIG. 2 illustrating an actuator portion of a dispensing mechanism.

In accordance with the invention, dispenser 43 is provided with both a first or manual actuator 110 (see FIG. 3) and a second or automatic actuator 111 (see FIG. 4). As best seen in FIG. 3, manual actuator 110 includes a first end portion 114 which is pivotally mounted relative to main body portion 46 and leads to a second end portion 116. In accordance with the embodiment shown, manual actuator 110 includes a substantially vertical, planar surface 118 which is provided with a raised rib 119. With this arrangement, raised rib 119 cooperates with recess 102 to selectively retain lid 89 in the closed position. In order to cause lid 89 to shift to the open position, manual actuator 110 is pivoted about first end 114 to allow raised rib 119 to disengage from recess 102. At this point, a spring (not shown) provides a biasing force that causes lid 89 to shift from the closed position (FIG. 2) to the open position (FIG. 3). Manual actuator 110 is typically employed to enable the loading and/or visual inspection of first reservoir 60 by a consumer prior to initiating a washing operation. During the washing operation, lid 89 is automatically shifted from the closed position to the open position to expose any detergent contained therein to jets of washing fluid as discussed further below.

Figure 5:
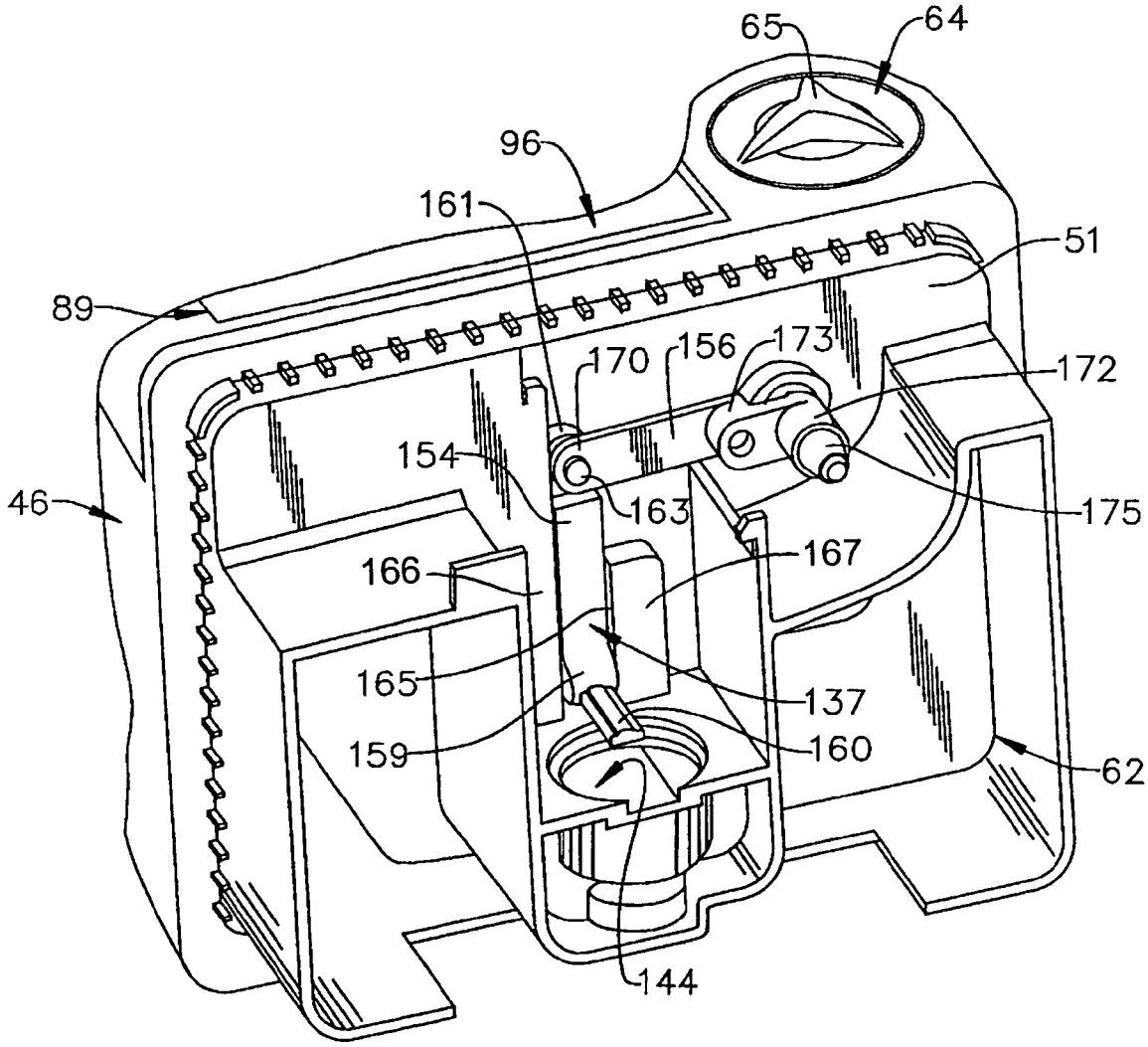
FIG. 5 is a rear perspective view of the detergent dispenser of FIG. 2 illustrating a linkage portion of the dispensing mechanism.

In accordance with the preferred embodiment of the present invention illustrated in FIGS. 4 and 5, automatic actuator 111 includes a linear actuator 134, which can be in the form of, for example, a wax motor or solenoid, operatively coupled to a linkage system 137. Linear actuator 134 includes an output shaft or first actuating element 139 which is adapted to engage and shift both a second actuating element 142 that is connected to a piston (not shown) and linkage system 137. The piston resides within a charging chamber 144 that is in fluid communication with second reservoir 62 and, as will be discussed more fully below, employed to discharge rinse aid into basin 28 during a select portion of the washing operation.

Referring to FIG. 5, linkage system 137 is shown to include a third actuating element 154 which is pivotally connected to a fourth actuating element 156. As shown, third actuating element 154 includes a first end 159 that is provided with a lever arm 160. First end 159 extends to a second end 161 that includes a pivot pin 163. In accordance with the invention, lever arm 160 is adapted to be operated on by first actuating element 139, while also being connected to second actuating element 142. In order to provide a degree of stability to linkage system 137, third actuating element 154 nests within a guide channel 165 formed by raised sections 166 and 167 formed on rear wall 51 of main body portion 46. In any event, fourth actuating element 156 includes a first end 170 having an opening (not separately labeled) that receives pivot pin 163. First end 170 extends to a second end 172 through an offset or stepped portion 173. Second end 172 is shown to include a collar (not separately labeled) which matingly engages with a shaft 175. Shaft 175 is operatively associated with manual actuator 110 such that operation of linkage system 137 rotates shaft 175 causing lid 89 to automatically shift from the closed position of FIG. 2 to the open position of FIG. 3.

In accordance with the invention, after charging first reservoir 60 with detergent and second reservoir 62 with rinse aid through lid 64, a consumer may initiate a washing operation in basin 28. Upon commencement of the washing operation, jets of washing fluid are directed about basin 28 from various upper and lower wash arms (not shown). If third reservoir 96 has been charged with detergent, the jets of washing fluid dilute the detergent contained therein to initiate a first or pre-wash operation. After the completion of any pre-wash operation, automatic actuator 111 is activated through a control system (not shown). More specifically, a first signal is sent to linear actuator 134 to initiate shifting of first and second actuating elements 139 and 142, while also acting upon lever arm 160 to raise third actuating element 154. Third actuating element 154 then acts upon fourth actuating element 156 resulting in the rotation of shaft 175 and the opening of lid 89. Once lid 89 is open to expose first reservoir 60, jets of washing fluid impinge upon detergent contained within first reservoir 60 creating a detergent solution employed during a second or main wash operation.

Prior to a final rinse cycle, the dishwasher control (not shown) signals linear actuator 134 a second time, causing first actuating member 139 to fully retract, thereby raising second actuating element 142 and causing the piston (not shown) to draw rinse aid into charging chamber 144 from second reservoir 62. At the initiation of the final rinse cycle, linear actuator 134 is de-energized, forcing first and second actuating elements 139 and 142 downward and causing the piston to move into chamber 144, thereby forcing rinse aid through opening 67 into basin 28. In a manner known in the art, the rinse aid mixes with rinse water so as to ensure a clean, final rinse to any dishware contained within basin 28.

Figure 6:
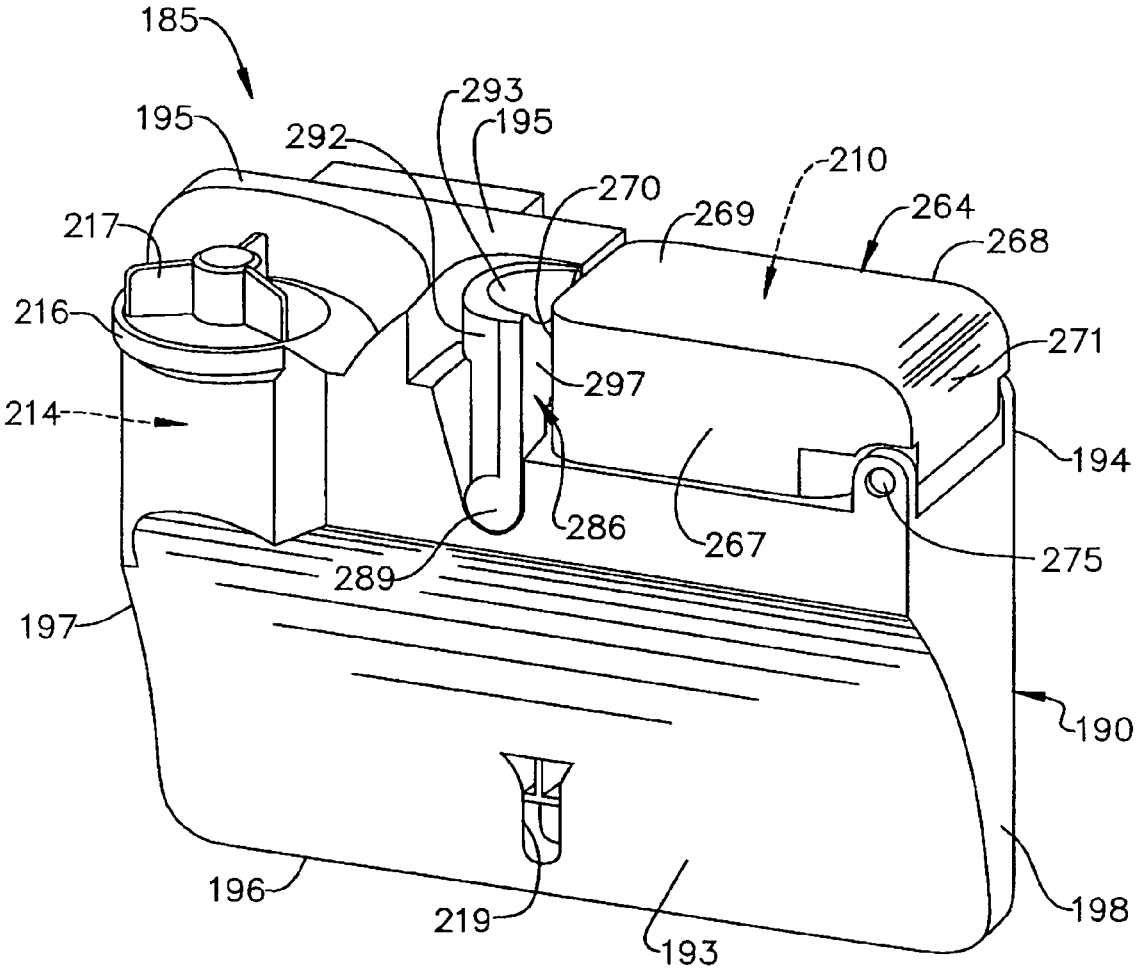
FIG. 6 is a perspective view of the detergent dispenser constructed in accordance with a second embodiment of the present invention.
Figure 7:
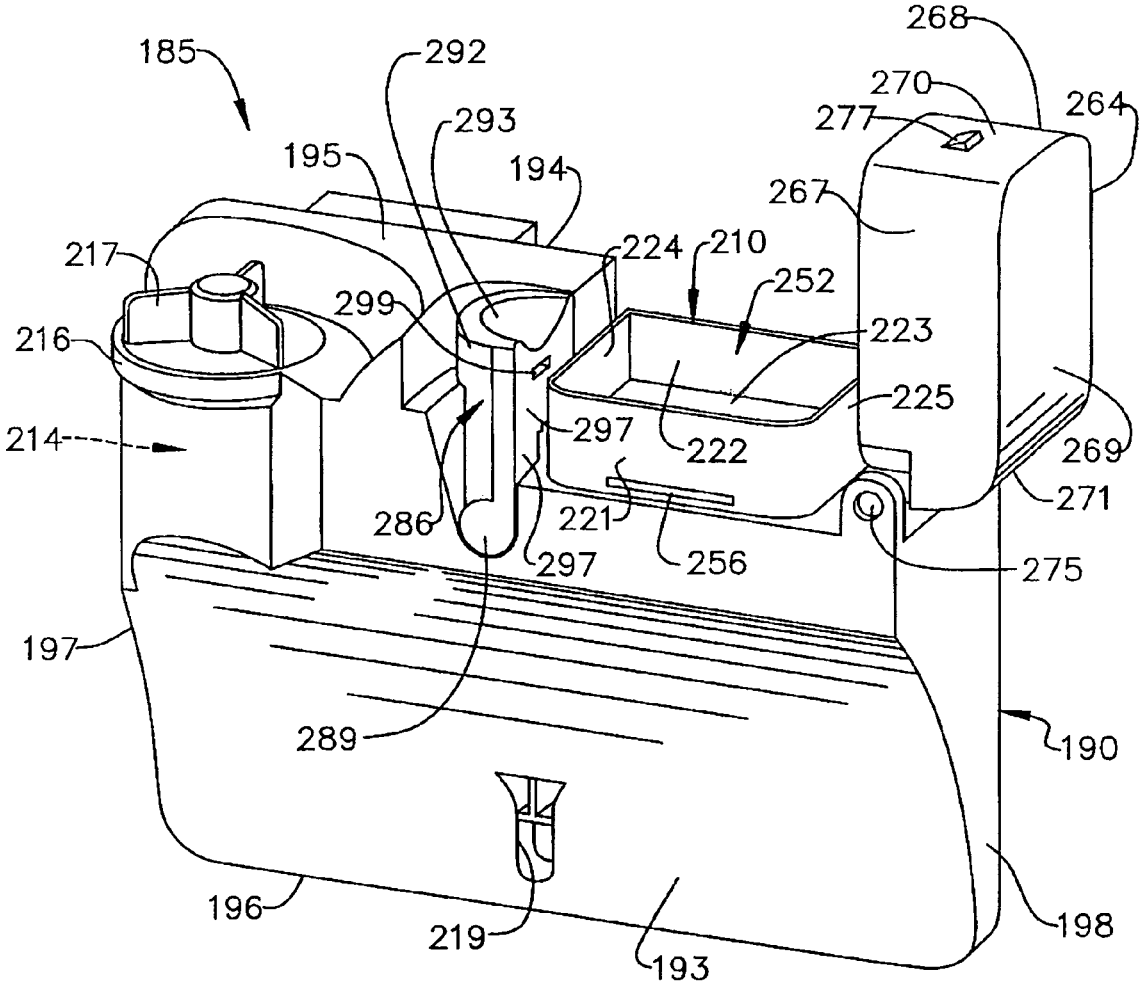
FIG. 7 is an is a perspective view of the detergent dispenser of FIG. 6 illustrated with a lid portion of the dispenser in an open configuration.
Figure 8:
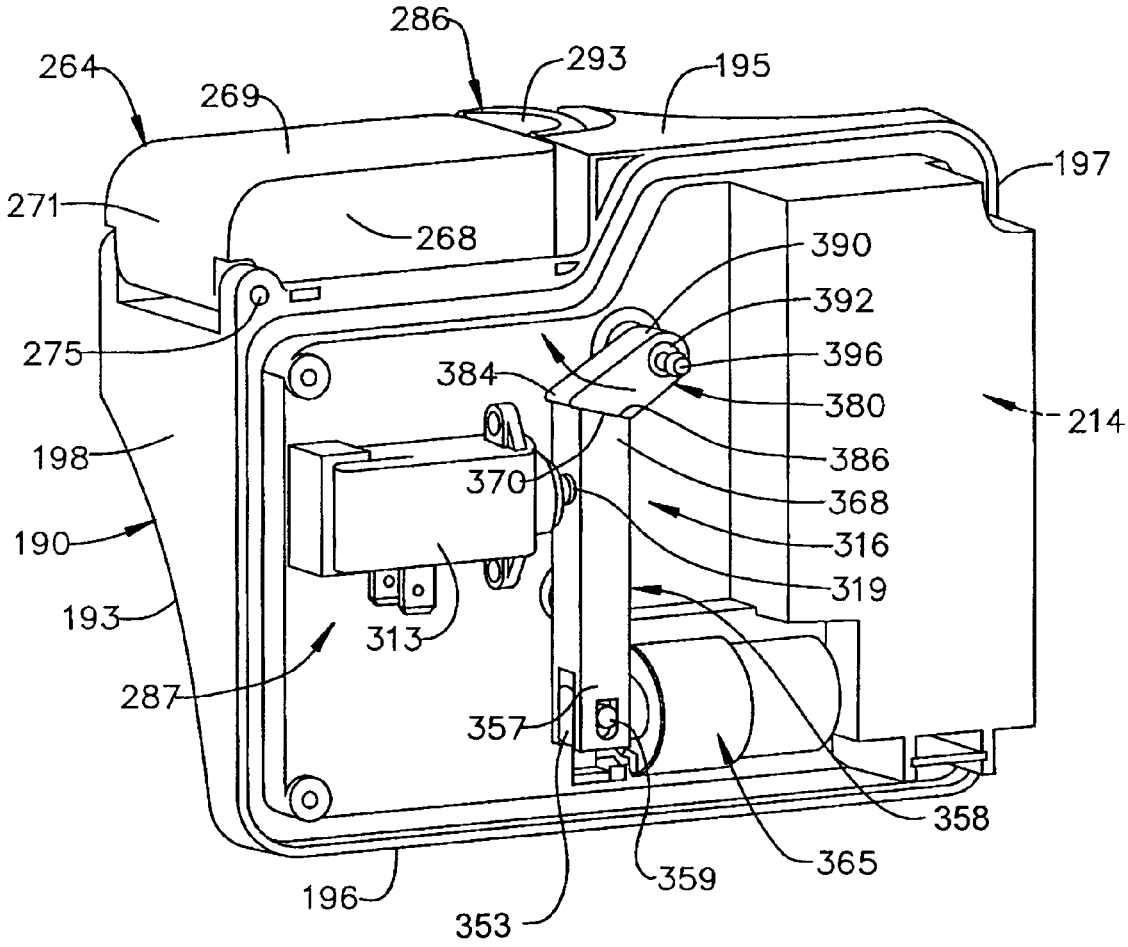
FIG. 8 is a rear perspective view of the detergent dispenser of FIG. 6 illustrating an actuator portion of a dispensing mechanism constructed in accordance with the second embodiment.

Reference will now be made to FIGS. 6-8 in describing a second embodiment of the present invention. In accordance with the embodiment shown, a dispenser 185 includes a main body portion 190 having front, rear, top, bottom and opposing side portions 193-198. Dispenser 185 is shown to include a first reservoir 210 for receiving detergent in liquid, particulate or solid form, as well as a second reservoir 214 for receiving and storing rinse aid. In a manner analogous to that set forth above, second reservoir 214 is provided with a lid 216 having a raised portion 217. Raised portion 217 enables a consumer to readily grasp and open lid 216 to expose second reservoir 214 and enable the addition of rinse aid. As will be discussed more fully below, front wall 193 of main body portion 190 is provided with an opening 219 which serves as a passage to enable rinse aid to be guided from second reservoir 214 into basin 28.

As best illustrated in FIG. 7, first reservoir 210 includes a front wall 221, a rear wall 222, a bottom wall 223 and opposing side walls 224 and 225 which collectively define a chamber 252. In the embodiment shown, arranged on front wall 221 is a drain port 256 which, in a manner corresponding to that described above, is sized and shaped to ensure that detergent remains within chamber 252 until diluted with washing fluid. That is, once chamber 252 is exposed to jets of washing fluid, a detergent/washing fluid mix can overflow sides 221-225 of chamber 252 while any remaining detergent mix can exit through drain port 256.

First reservoir 210 is provided with a lid 264, having front, rear, top, and opposing side wall portions 267-271, pivotally mounted relative to main body portion 190 through a hinge pin 275. As further shown, front wall portion 267 serves as a cover for drain port 256 when lid 264 is in the closed position. Lid 264 is also provided with a boss 277 arranged on side wall 270 which, in a manner that will be detailed more fully below, is adapted to selectively retain lid 264 in the closed position.

Dispenser 185 is provided with a first or manual actuator 286 (see FIGS. 6 and 7) which enables a consumer to charge first reservoir 252 with detergent, as well as a second or automatic actuator 287 (see FIG. 8) which selectively operates lid 264 during a portion of the washing operation. Manual actuator 286 includes a first end 289 that is pivotally mounted and spring biased relative to main body portion 190. First end 289 extends to a second end 292 having formed therein a depression 293. Depression 293 enables easy manipulation of manual actuator 286 by a consumer. As best shown in FIG. 7, manual actuator 286 also includes a substantially planar surface 297 positioned adjacent first reservoir 210. Formed in planar surface 297 is a recess 299 that is adapted to cooperate with boss 277 to selectively retain lid 264 in the closed position. When it is desirable to open lid 264, a consumer simply need pivot manual actuator 286 against a biasing force about first end 289. Pivoting manual actuator 286 causes recess 299 to disengage from boss 277 thereby allowing lid 264 to automatically shift to the open position. More specifically, given that lid 264 includes a spring (not shown), once boss 277 disengages from recess 299, lid 264 is biased into the open position.

Referring to FIG. 8, in order to automatically open lid 264 during the washing operation, automatic actuator 287 includes an electrically operated linear actuator, such as, for example, a wax motor or solenoid, indicated generally at 313. Linear actuator 313 is operatively coupled to a linkage system 316 through a first actuating element 319. In general, when a control (not shown) activates linear actuator 313, first actuating element 319 engages with linkage system 316 to automatically operate lid 264. Towards that end, linkage system 316 defines a second actuating element 353 pivotally connected to a first end 357 of a third actuating element 358 by a pin 359. More specifically, second actuating element 353 is operatively associated with a piston assembly (not shown) arranged in a charging chamber 365. First end 357 extends to a second end 368 which is provided with an angled surface 370 that is operatively connected to a fourth actuating element 380. Fourth actuating element 380 includes a first end 384 provided with a corresponding angled surface 386 which extends to a second end 390 that is provided with an opening 392. Opening 392 receives a shaft 396 that is keyed to manual actuator 286.

With this particular arrangement, once a control (not shown) energizes linear actuator 313, first actuating element 319 extends outward causing third actuating element 358 to pivot about pin 359. Initially, first actuating element 319 extends only a small amount, causing angled surface 370 to ride against angled surface 386. This movement causes fourth actuating element 380 to pivot and shaft 396 to rotate so as to deflect manual actuator 286 in order to allow lid 264 to open. In this manner, first reservoir 210 is exposed to jets of washing fluid allowing the detergent contained therein to become diluted and enter into basin 28. As the washing operation progresses, first actuating element 319 extends further causing second actuating element 353 to shift relative to charging chamber 365 creating a vacuum in chamber 365. The vacuum causes rinse aid to be withdrawn from second reservoir 214 and directed into charging chamber 365. Once charging chamber 365 contains rinse aid, a signal is sent to linear actuator 313 which causes first actuating element 319 to retract, forcing rinse aid from charging chamber 365 out opening 219 and into basin 28. Preferably, the signal is sent to linear actuator 313 during a final rinse phase such that the rinse aid mixes with the fluid in wash tub 28 to ensure a clean, final rinse.

Reference will now be made to FIGS. 9-14 in describing a third embodiment of the present invention. In accordance with the embodiment shown, a dispenser 500 includes a main body portion 510 having front, rear, top, bottom and opposing side portions 515-520. Dispenser 500 is shown to include a first reservoir 530 for receiving detergent in liquid, particulate or solid form, as well as a second reservoir 531 for receiving and storing liquid rinse aid. In a manner analogous to that set forth above, second reservoir 531 is provided with a lid 540 have a raised portion 541. Raised portion 541 enables a consumer to readily grasp and open lid 540 exposing second reservoir 531 to enable the addition of liquid rinse aid which, in a manner also corresponding to that described above, is selectively released from second reservoir 531 into basin 28 during a rinse cycle portion of an overall washing operation.

As shown, first reservoir 530 is provided with a lid 545, having front, rear, top and opposing side wall portions 546-550, pivotally mounted relative to main body portion 510 through a pair of rear hinges 552*a* and 552*b*. Hinges 552*a* and 552*b* allow lid 545 to rotate upward to expose first reservoir 530. Lid 545 is also provided with a protrusion or boss 551 (see FIGS. 10 and 11) arranged on side wall 549 which, in a manner similar to that described above, cooperates with an actuating mechanism to selectively retain lid 545 in the closed position. That is, dispenser 500 includes a manual actuator 553 that is selectively operated by a consumer to expose first reservoir 530 and an automatic actuator system 555 which is arranged on back wall 516 and controlled by dishwasher 2 to selectively open lid 545, exposing first reservoir 530 during select portions of a washing operation. Automatic actuating system 555 includes a linear actuator 560, coupled to a linkage system 565 having a plurality of linkage elements, two of which are indicated at 567 and 568, that are operated to selectively dispense either rinse aid and detergent from dispenser 500. However, as the operation of linkage system 565 directly corresponds to that described above, further discussion will not be provided herein. Instead, the focus of the third embodiment lies in the particular incorporation and orientation of a third reservoir or pre-wash chamber 574 into dispenser 500.

Figure 9:
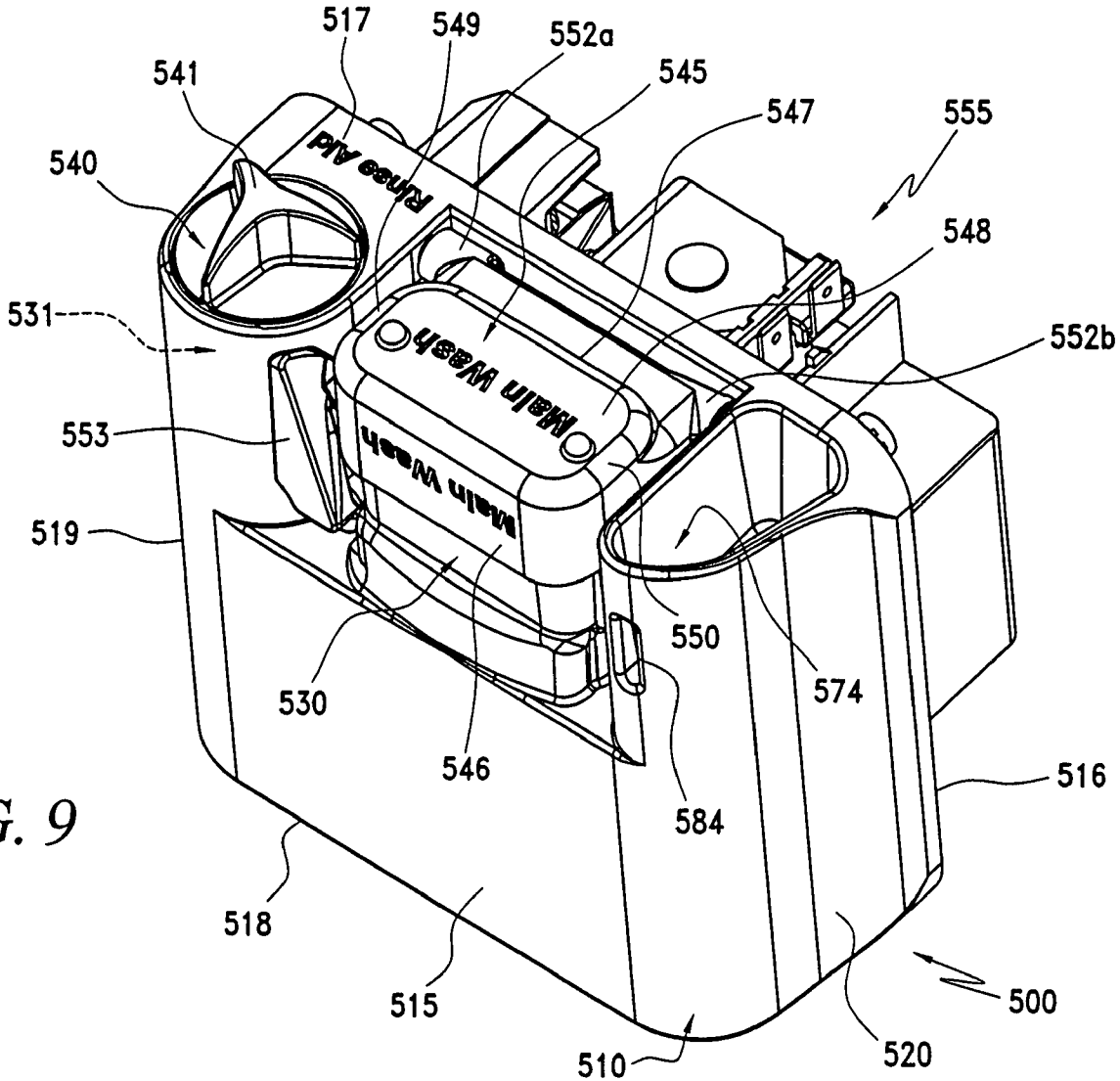
FIGS. 9-14 illustrate a still further embodiment of the invention.
Figure 10:
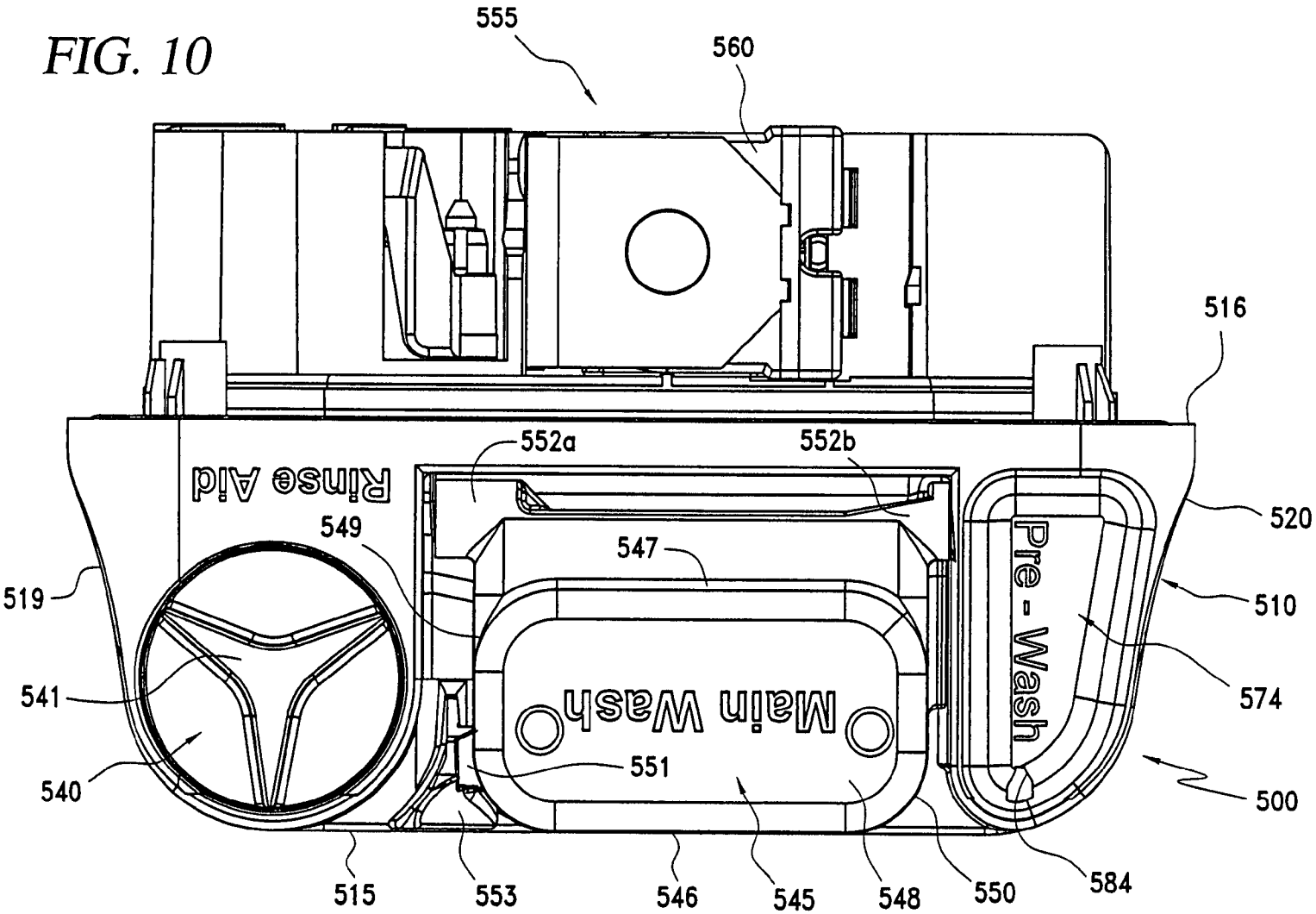
Figure 11:
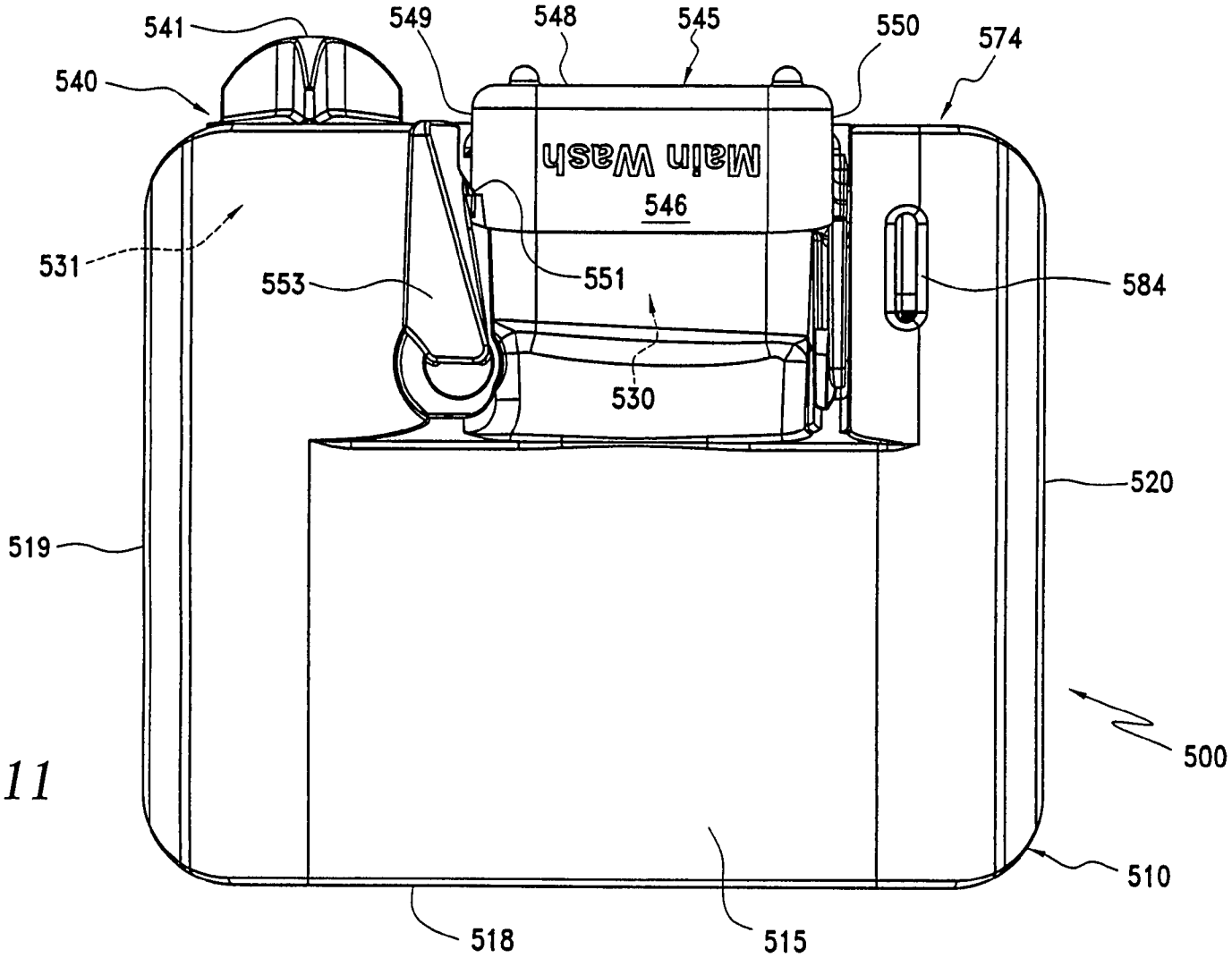
Figure 12:
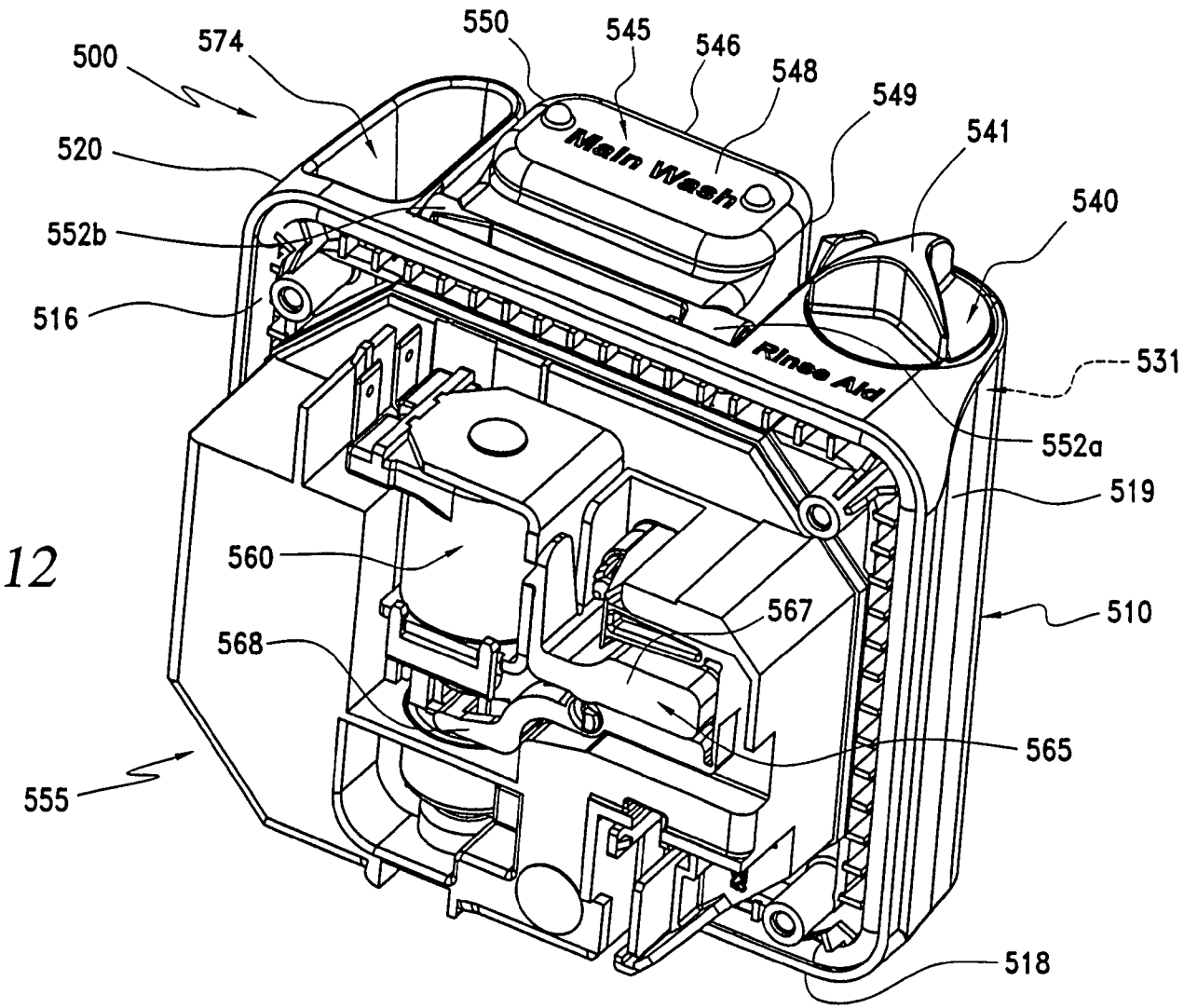
Figure 13:
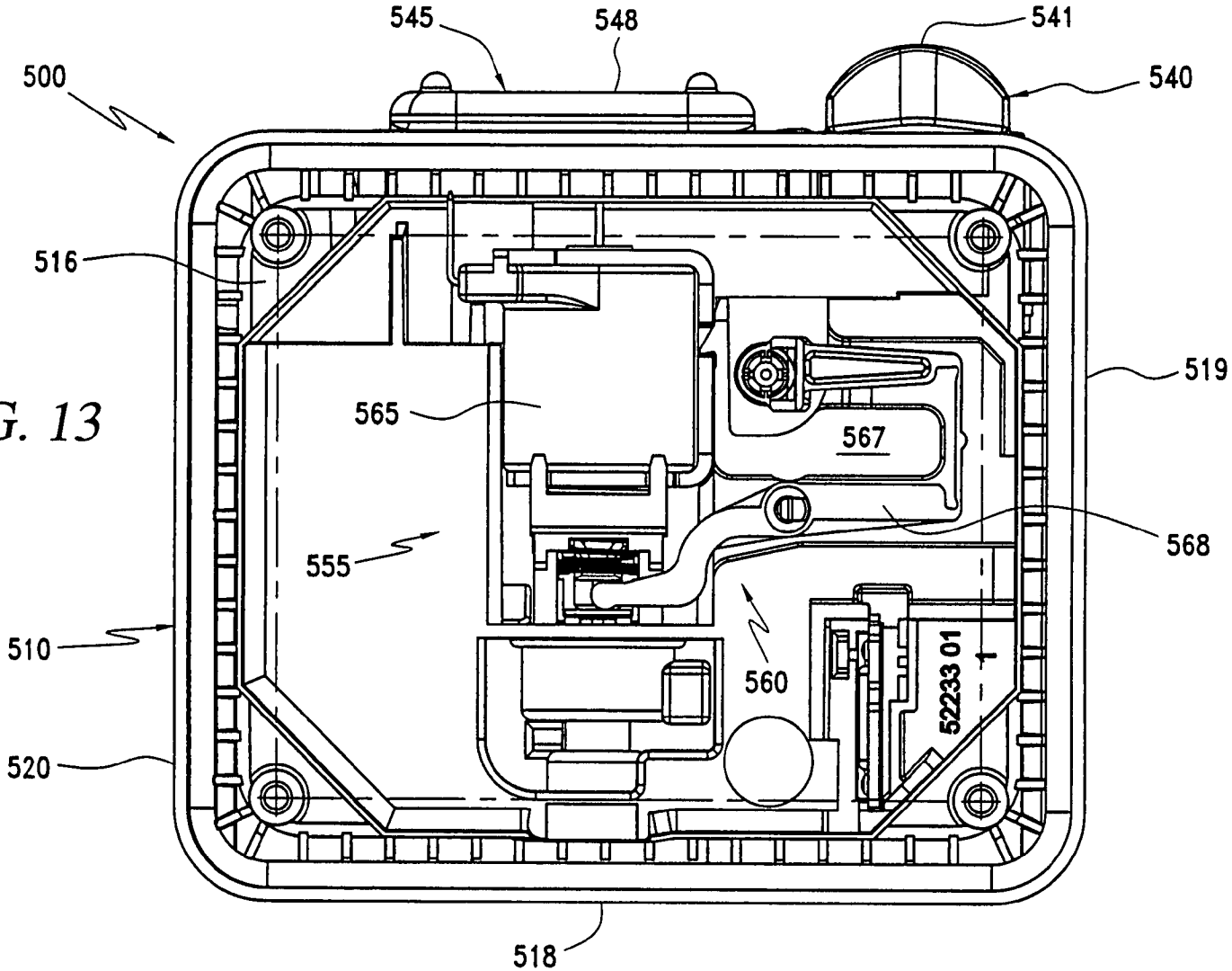
Figure 14:
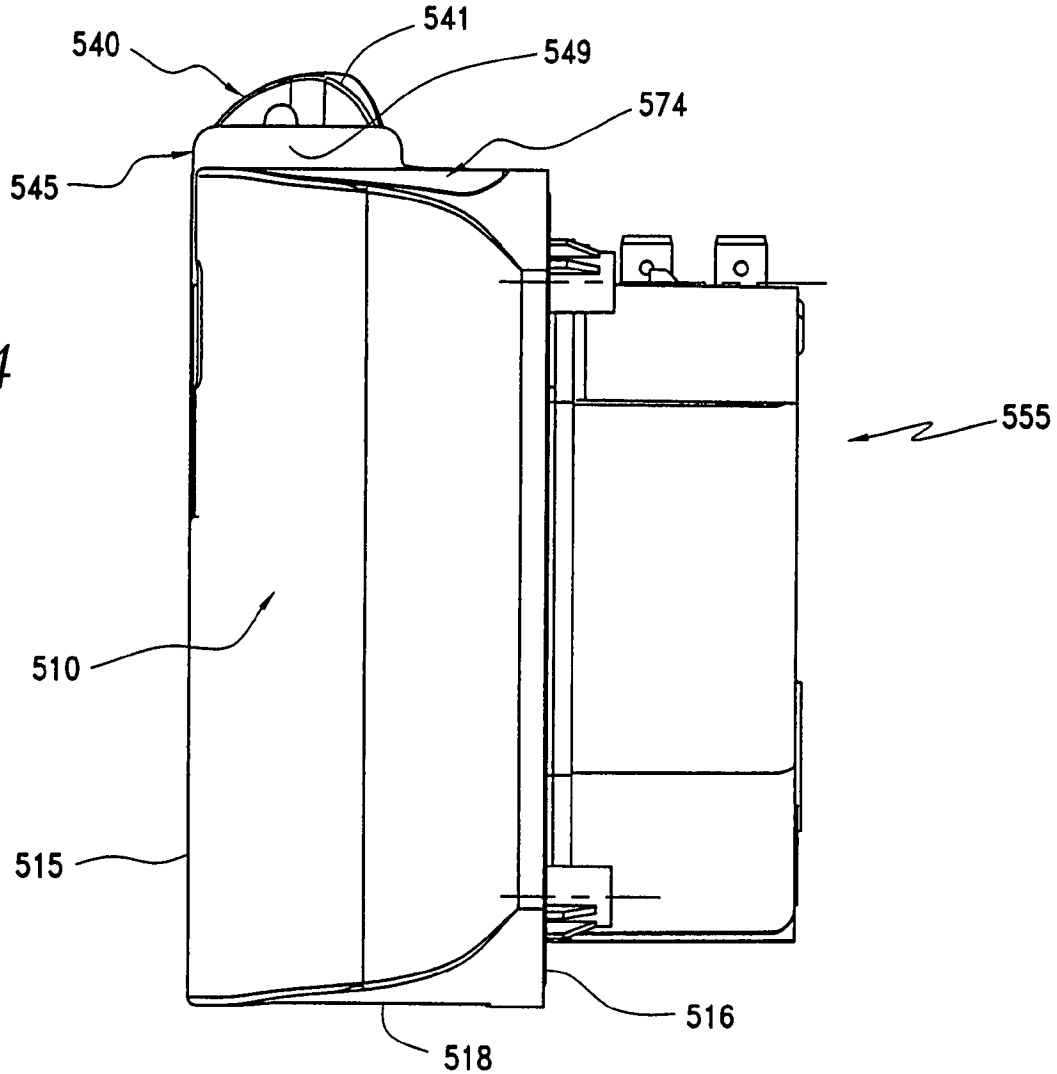

As best shown in FIGS. 9-11, pre-wash chamber 574 is integrally formed in main body portion 510 and positioned adjacent to first reservoir 530. Pre-wash chamber 574 is provided with an opening 584 that enables diluted detergent or a pre-washing fluid mixture to drain from dispenser 500 into washing chamber 28. That is, if a consumer desires to perform a pre-wash cycle in washing chamber 28, detergent in liquid, particulate or solid form is placed into pre-wash chamber 574. During the washing operation, washing fluid is directed into pre-wash chamber 574, causing the detergent contained therein to dissolve and/or become diluted so as to pass through opening 584 into washing chamber 28. The detergent then mixes with washing fluid and is directed upon dishware to perform a pre-wash operation.

Based on the above-discussed preferred embodiments, it should be readily understood that, given the construction of dishwasher 2, the dispensers of the present invention enable a consumer to charge dishwashing detergent in a top portion of a dispenser, while enabling or providing a path for washing fluid to mix with and dilute the detergent for release into the dishwasher. Although described with reference to preferred embodiments of the invention, it should be readily understood that various changes and/or modifications can be made to the invention without departing from the spirit thereof. For instance, while each dispenser is shown mounted to a respective front wall, other locations, such as the side walls, would also be acceptable. Also, it should be noted that the presence of a reservoir in the dispenser lid is but one option, with other locations also being acceptable. In general, the invention is only intended to be limited by the scope of the following claims.

We claim:

1. A dishwasher comprising:

an outer body;

a basin slidably supported in the outer body, said basin including front, rear, bottom and opposing side walls that collectively define a wash chamber; and a dispenser supported on one of the front and opposing side walls of the basin, said dispenser including:

a main body portion;

a first reservoir formed in the main body portion for receiving detergent, said first reservoir being defined by front, rear, bottom and opposing side walls, with the bottom wall being arranged in a generally horizontal plane and the first reservoir having an open top portion exposing the first reservoir for filling from above;

a drainage port provided in one of the front, rear and opposing side walls of the first reservoir;

a lid hingedly mounted to the main body portion, said lid being movable between an open position, wherein the lid rotates upward about a hinge axis to expose the first reservoir such that the first reservoir can be directly exposed to jets of washing fluid, and a closed position wherein the lid is rotated downward about the hinge axis to cover the open top portion such that the first reservoir is shielded from jets of washing fluid and the drainage port is blocked by the lid;

a first actuator for manually operating the lid; and a second actuator for operating the lid, said second actuator opening the lid during a washing operation in order to expose both the first reservoir and drainage port to washing fluid.

2. The dishwasher according to claim 1, wherein the dispenser further includes a second reservoir for selectively storing rinse aid.

3. The dishwasher according to claim 1, wherein the first actuator is constituted by a pivotally mounted element operatively coupled to the lid.

4. The dishwasher according to claim 1, wherein the second actuator is constituted by a linear actuator mounted to the main body portion, said linear actuator including a first actuating element being operated to open the lid during a predetermined portion of the washing operation.

5. The dishwasher according to claim 4, further comprising: a linkage system operatively coupled to both the linear actuator and the first actuator.

6. The dishwasher according to claim 5, wherein the linkage system includes second, third and fourth actuating elements, said fourth actuating element being connected to the first actuator, said third actuating element being acted upon by the linear actuator to shift the fourth actuating element and the first actuator to open the lid.

7. The dishwasher according to claim 6, wherein the third actuating element is pivotally connected to the fourth actuating element.

8. The dishwasher according to claim 6, wherein the third actuating element includes a first angled surface which abuts a second angled surface of the fourth actuating element, wherein pivoting the third actuating element causes the first angled surface to slide relative to the second angled surface resulting in rotary movement of the fourth actuating element which opens the lid.

9. The dishwasher according to claim 1, wherein the drainage port is constituted by an opening formed in a bottom portion of one of the opposing side walls of the reservoir.

10. The dishwasher according to claim 1, wherein the dispenser is mounted to the front wall of the basin.

11. A dishwasher comprising:

an outer body;

a basin slidably supported in the outer body, said basin including front, rear, bottom and opposing side walls that collectively define a wash chamber; and a dispenser supported on one of the front and opposing side walls of the basin, said dispenser including:

a main body portion;

a first reservoir formed in the main body portion for receiving detergent, said first reservoir being defined by front, rear, bottom and opposing side walls;

a drainage port provided in one of the front, rear and opposing side walls of the first reservoir;

a lid hingedly mounted to the main body portion, said lid being movable between an open position, wherein the first reservoir can be directly exposed to jets of washing fluid, and a closed position wherein the first reservoir is shielded from jets of washing fluid and the drainage port is blocked;

a first actuator for manually operating the lid;

a second actuator for operating the lid, said second actuator opening the lid during a washing operation in order to expose both the first reservoir and drainage port to washing fluid;

a second reservoir for selectively storing rinse aid; and a third reservoir for selectively storing detergent for a pre-wash operation.

12. The dishwasher according to claim 11, wherein the third reservoir is formed in the lid of said first reservoir.

13. The dishwasher according to claim 11, wherein the third reservoir is positioned adjacent to the first reservoir, said third reservoir including an opening exposed to the wash chamber allowing detergent to pass from the third reservoir into the basin.

14. A dishwasher comprising:

an outer body;

a basin slidably supported in the outer body, said basin including front, rear, bottom and opposing side walls that collectively define a wash chamber; and a dispenser supported on one of the front and opposing side walls of the basin, said dispenser including:

a main body portion;

a first reservoir formed in the main body portion for receiving detergent, said first reservoir being defined by front, rear, bottom and opposing side walls;

a drainage port provided in one of the front, rear and opposing side walls of the first reservoir;

a lid hingedly mounted to the main body portion, said lid being movable between an open position, wherein the first reservoir can be directly exposed to jets of washing fluid, and a closed position wherein the first reservoir is shielded from jets of washing fluid and the drainage port is blocked;

a first actuator for manually operating the lid;

a second actuator for operating the lid, said second actuator opening the lid during a washing operation in order to expose both the first reservoir and drainage port to washing fluid, wherein the second actuator is constituted by a linear actuator mounted to the main body portion, said linear actuator including a first actuating element being operated to open the lid during a predetermined portion of the washing operation;

a linkage system operatively coupled to both the linear actuator and the first actuator;

a second reservoir for selectively storing rinse aid; and a charging reservoir which is filled with a portion of the rinse aid from the a second reservoir upon movement of the linkage system in a first direction and emptied of the portion of the rinse aid upon movement of the linkage system in a second, opposing direction.

* * * * *